United States Patent [19]

Edmund-White

[11] Patent Number: 4,667,829

[45] Date of Patent: May 26, 1987

[54] PROPERTY SALES SIGN CASE

[76] Inventor: Barrie E. Edmund-White, Two Amira Court, Bourne Avenue, Bournemouth, England

[21] Appl. No.: 690,234

[22] Filed: Jan. 10, 1985

[30] Foreign Application Priority Data

Jan. 13, 1984 [GB] United Kingdom ..... 8400977

[51] Int. Cl.[4] ..... B65D 69/00

[52] U.S. Cl. ..... 206/575; 206/577; 206/216; 206/474; 206/592; 40/607

[58] Field of Search ..... 206/573, 575, 577, 579, 206/474, 216, 803, 592; 40/306, 307

[56] References Cited

U.S. PATENT DOCUMENTS

| | | | |
|---|---|---|---|
| 808,764 | 1/1866 | Larsh | 40/607 |
| 1,849,361 | 3/1932 | Brett | 40/606 |
| 2,343,272 | 3/1944 | Armstrong | 206/573 |
| 2,387,790 | 10/1945 | Williamson | 206/474 |
| 2,639,454 | 5/1953 | Dory | 206/577 |
| 2,742,956 | 4/1956 | Cannata | 206/577 |
| 2,882,629 | 4/1959 | Moebius | 40/607 |
| 2,939,236 | 6/1960 | Stein | 40/607 |
| 3,032,183 | 5/1962 | Magazanik | 206/573 |
| 3,575,290 | 4/1971 | Stork | 206/577 |
| 3,596,754 | 12/1971 | Peterson, Jr. | 206/592 |
| 3,596,866 | 8/1971 | Baker | 206/216 |
| 3,711,974 | 1/1973 | Webb | 40/606 |
| 3,829,008 | 8/1974 | Murray et al. | 229/87 R |
| 4,108,311 | 8/1978 | McClendon | 206/573 |
| 4,225,039 | 9/1980 | Skaggs | 206/474 |
| 4,233,769 | 11/1980 | Archer | 40/607 |
| 4,317,519 | 3/1982 | Talley | 206/577 |
| 4,322,905 | 4/1982 | Kruse | 40/606 |
| 4,437,568 | 3/1984 | Hamblin | 206/573 |
| 4,444,354 | 4/1984 | Staelgrave | 206/459 |
| 4,456,126 | 6/1984 | Hicks, Jr. | 206/803 |
| 4,471,873 | 9/1984 | Thomas | 206/575 |

FOREIGN PATENT DOCUMENTS

| | | | |
|---|---|---|---|
| 1152744 | 8/1983 | Canada | 40/606 |
| 2239386 | 2/1975 | France | 206/459 |
| 2270654 | 12/1975 | France | 40/607 |
| 661529 | 11/1951 | United Kingdom | 40/606 |
| 750108 | 6/1956 | United Kingdom | 40/607 |
| 1517672 | 7/1978 | United Kingdom | 206/579 |

*Primary Examiner*—George E. Lowrance
*Assistant Examiner*—Brenda J. Ehrhardt
*Attorney, Agent, or Firm*—Rosen, Dainow & Jacobs

[57] ABSTRACT

A case 1 of conventional appearance, fastened by adhesive tape around its parting line and having a carrying handle 2 can be opened, emptied of contents including a number of like lengths of wood 3 (for example) capable of being assembled into a single support post, and folded inside-out to show a pre-printed advertising sign 21 of professional appearance for support by the post to facilitate sale of a house by the owner-occupier. Other useful adjuncts to such a fabrication (such as adhesive, wire, gloves, adhesive tape, nuts and bolts) or for such a transaction (booklets, leaflets, stickers, labels, check-lists) can also be incorporated in the kit. In a variant, not shown, the post sections are grooved at the ends, and the topmost is grooved along one face, so that (a) the end grooves jointly and the face groove individually trap inwardly turned margins around the case of (b) the face groove traps an outwardly turned margin along one edge of the supported sign.

13 Claims, 17 Drawing Figures

FIG. 16
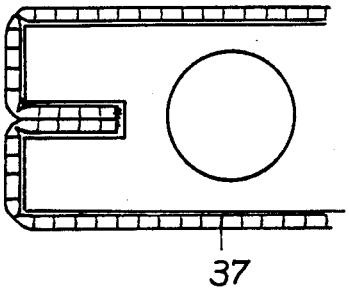
FIG. 14
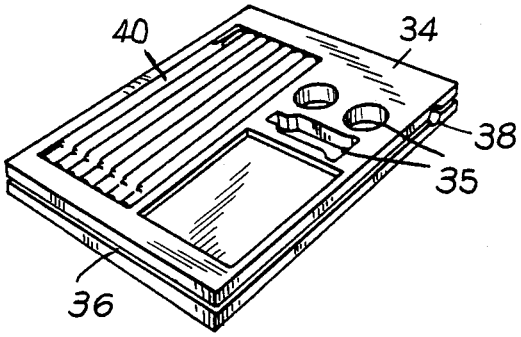
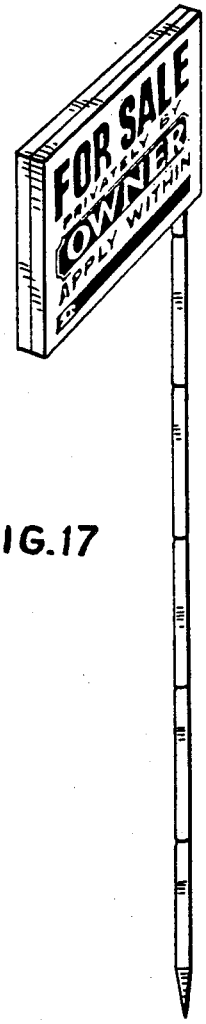
FIG. 17
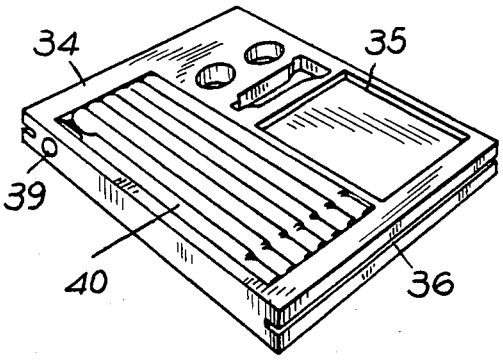
FIG. 15

PROPERTY SALES SIGN CASE

This invention relates to a kit of parts for facilitating the sale of real estate, and in particular of owner-occupied residential property. More especially, the invention relates to such a kit of parts a major component of which is a readily fabricated and erected sign board.

Estate agency flag-board signs are well known and usually comprise a post supporting a panel on either side of which panel is printed or sign-written brief details of the proposed sale, lease or let; the name, address and telephone number of the Agent; and brief details of viewing conditions.

Selling by agent can be unnecessarily expensive particularly if the owner selling (a) has the available time to deal with advertising and enquiries (b) owns a property which is well maintained, lies in a popular area, is accurately valued and falls within a price range currently in demand and (c) possesses a pleasant, patient, articulate manner. Even an owner without experience in selling can save himself a considerable sum if some or all of the above circumstances apply. However, one problem which presents itself to a layman is that of readily advertising the property in a prominent and professional manner, giving the impression to a prospective purchaser of competent trouble-free negotiation. Other problems lie in remembering the large number of small practical stages to take when moving house without experienced help.

The present invention sets out to overcome the above problems by providing a kit of parts which includes an enclosing case printed with advertising matter on surfaces thereof, enclosing the remaining parts, and of a structure such as to be readily convertible into a signboard to display the printed matter.

In one aspect the invention provides a kit of parts to facilitate sale of owner-occupied residential property, comprising at least (a) a shallow enclosing case folded into shape from at least one suitable blank, closed by a releasable closure and printed on at least one face thereof with advertising indicia generally relevant to house sale by an owner-occupier; and (b) within the case, a plurality of support means for an advertising sign: the case structure and materials being such as to permit (i) opening of the case to remove support means and any other enclosures (ii) arrangement of the case so as to form an advertising sign displaying the said indicia and (iii) support of the sign using the support means.

Preferably the advertising indicia will appear on at least one and usually both internal faces of the case, which must therefore be opened out emptied and refolded before support as an advertising sign.

The case will usually be rectangular although other shapes e.g. square or octagonal are possible. Usually, one blank of foldable material will be used (such a blank itself is an aspect of the present invention) one surface of which is provided with the advertising indicia and the other with a suitable external finish to the enclosing case.

The closure can be a simple clip, pin or peg attachment.

However, one valuable form of closure is a strip of polymer double-leafed along each edge to fit over an edge of the foldable blank material and flexible to follow the case periphery; such a strip can be used either for the "case" mode of "sign" mode.

Another form of closure may be constructed by folding the margins of the blank to give a wall portion and an innermost marginal portion parallel to the face of the blank and suitable (a) for single or joint entrapment by localised content of the case when un-opened and (b) for like entrapment by the support when the case is supported thereby.

Typically the case can be constituted as a carrying case with a suitable handle; indeed, one form of the invention provides the case, with a handle, to resemble an A2 size artists portfolio case externally.

It will be appreciated that usually the internal general advertising indicia (e.g. large type wording such as "FOR SALE PRIVATELY BY OWNER-APPLY WITHIN" are applied twice to the blank so that the essential sign is double-sided.

Weather-resistant signboard material is already known per se for external advertising signs, possessing a cellular core and comprising synthetic polymeric material at least at the surface. I have found such material to be preferable since it can be cut to a suitable blank, and provided with fold lines of both fold directions, and since it supports the internal parts when fabricated as a carrying case.

The support means usually comprises a number of lengths of rigid material, fitting within the case and adapted for assembly into one single support length, e.g. by axial bores and complementary projections or by end mortise slots and separate tennon pieces , the support length may be fabricated of any rigid material including polymers or metal, but are usually to be made of wood. One of the lengths can be shaped with a point for hammering into the ground: if so it may have an elongate upper axial projection to guide the second such piece as a mallet. Alternatively, a pointed metal member can be provided to constitute the lowest portion of the support means. Some or all of the lengths can be transversely drilled so that they can also be secured by lashing to adjacent trees or fences, etc. The sign can be so dimensioned and apertured (or provided with breakaway portions) as to permit the topmost section to be thrust between the side faces, to lie inside the sign, and be secured thereto e.g. by nuts and bolts; alternatively, the topmost section can be grooved to receive a folded marginal region of the blank.

The kit of parts can therefore comprise further components,such as securing and/or jointing devices, adhesives such as a tube of glue for glueing the lengths of wood together, and/or wire loops for securing the post laterally, and/or suitable nuts and bolts, and/or adhesive tape for securing the refolded sign.

In advantageous commercial embodiments the case can also contain, as additional components for the kit of parts, one or more of:

(a) optional labels adapted to be attached to the sign e.g. "VIEW BY APPOINTMENT ONLY" or "SOLD";

(b) a sheet of detachable numerals to apply to a blank surface to give a telephone number indication;

(c) gloves to protect against glue or accident;

(d) an internal locating tray for the minor components as listed above;

(e) booklets and leaflets generally, e.g. on the law relating to property sale; as checklists for vendor and purchaser; on the amenities of a given area; as newspaper or newsagent advertisement forms; as specification sheets with disclaimer; as measuring tape and graph sheets; as paper "FOR SALE" signs (to adhere to the windows of a flat in a block); as a register to note names, addresses, phone numbers, and offers made; as land register forms, change of address forms, etc. All of these papers can bear the logo or trade name of the case/sign distributor.

In a variant form of the invention, the kit of parts may further comprise an internal stabilising packaging block or tray of essentially the same dimensions as the interior of the assembled case or sign, and configured to localise the other components within the case prior to assembly.

Such a block or tray may be made of rigid expanded polymer e.g. polyurethane foam or polystyrene, and/or be grooved around at least part of its edge faces to receive marginal portions of the case or sign.

The invention will be further described by way of example with reference to the accompanying drawings in which.

Figure 1:
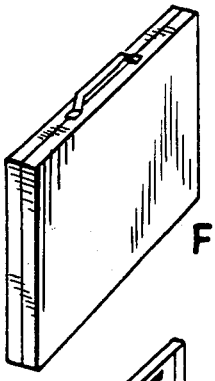
FIG. 1 shows in perspective a case in a suitable transit or delivery mode.
Figure 2:
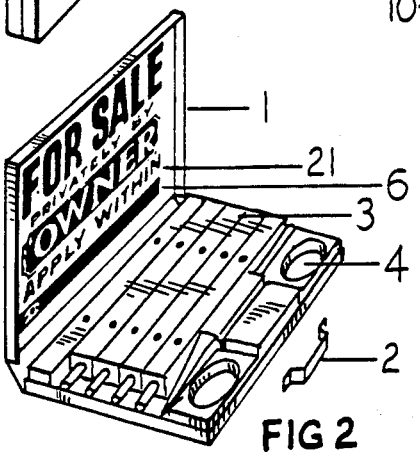
FIG. 2 shows the opened case and contents with the handle removed.

The case 1 shown in FIGS. 1 and 2 may for example resemble an artists A2 slim carrying case, with a handle 2 halfway along one long edge. It can possess a polymer strip with each edge double leafed to retain an edge of a case half, but this is only shown diagrammatically as a single median line in FIG. 1.

When the case is opened and handle 2 removed (FIG. 2) it can be seen to be formed as a simple folded structure, around fold lines which can be used in either fold direction. Inside the lid is a first body of wording 21 general to all house sales by an owner, and a second indicated location 6 for specific marking e.g. a telephone number. The case contains a number of like lengths of wood 3 and a subtray 4, all fitting neatly within the sides of the case.

Figure 3:
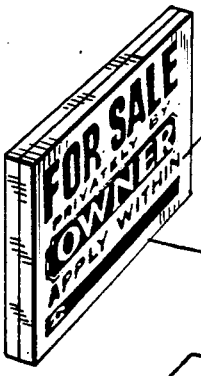
FIG. 3 shows the case re-folded as a sign.

FIG. 3 shows the case empty and refolded as a sign. The floor of the case, not shown in FIG. 2, forms the back of the sign, not shown in FIG. 3 and carries the same markings 21 and 6 as the inside of the case lid.

Figure 4:
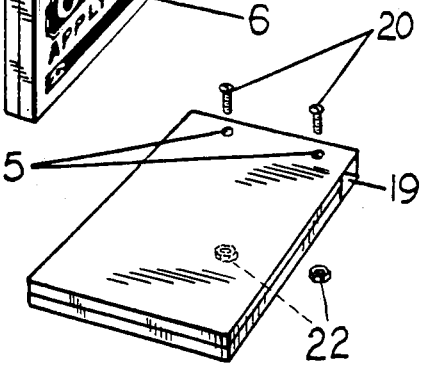
FIG. 4 shows an adaptation by which the sign can be attached to a post.

FIG. 4 shows the sign (wording omitted) with a portion 19 torn away at suitable peforations to define an entrance aperture for a post. Through holes 5 are marked for user to break out from the case to accommodate bolts 20 secured by nuts 22 as described below.

Figure 5:
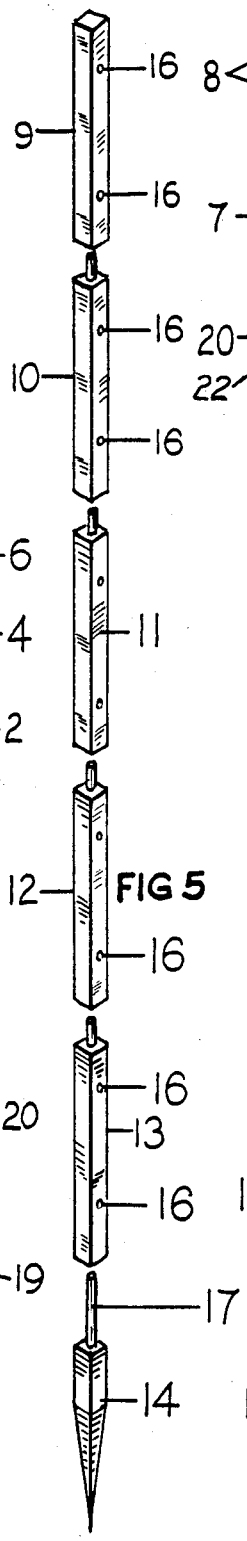
FIG. 5 shows in exploded view a post which can be assembled from wooden portions as carried in the case.

FIG. 5 shows in exploded view a post, with the individual lengths (jointly referenced at 3) labelled from the top down as 9, 10, 11, 12, 13 and 14. Length 9 has a lower axial bore (not shown) and two transverse bores 16, which on assembly accommodate bolts 20. Lengths 10 to 13 are equal, each possessing the lower axial bore (not shown) and an upper axial projection to fit into the bore of the section above. Length 14 is of the same length overall, but has a longer upper projection 17 (thus necessitating a longer bore in piece 13) and a pointed lower end. This feature allows length 14 to be conveniently driven into the ground by length 13, (or a pre-assembled and glued subassembly of 9–13), as a "tube mallet" beating on the top face of length 14.

Figure 6:
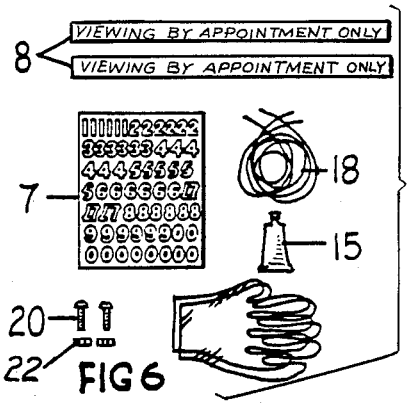
FIG. 6 shows in diagrammatic layout a selection of typical case contents.

FIG. 6 shows a typical layout of component parts also held within the box, comprising (a) stickers 8 stating "VIEW BY APPOINTMENT ONLY" to cover the "APPLY WITHIN" sign if desired (b) sheet of detachable numbers 7(*c*) wire 18 to pass through holes 16 as a lateral securing restraint (d) tube of glue 15 to immobilise the various lengths of wood 9–14, nuts 22 and bolts 20, pair of gloves, etc. Other features, especially leaflets etc, can also be present.

Figure 7:
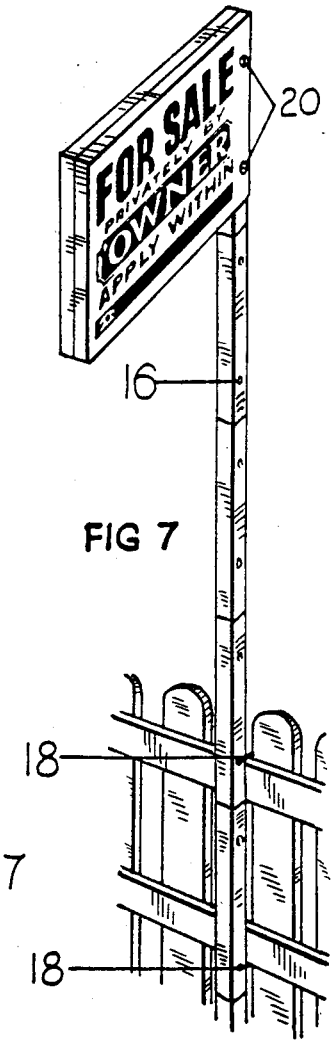
FIG. 7 shows the erected sign.

FIG. 7 shows the erected sign, with the assembled post not only secured in the ground but lashed by wire 18 to a fence, and with the sign pointing inwards to the property.

The case 23 as shown in the FIG. 8 can again be fabricated to resemble a normal A2 carrying case. It possesses, however, a handle in two parts stamped out as part of the case blank. It may be secured as before by metallised pressure-sensitive adhesive tape.

Figure 9:
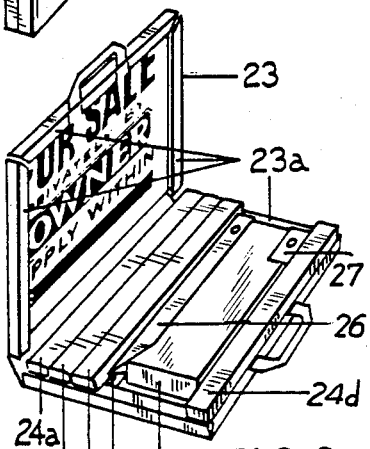
FIG. 9 shows the alternative case partly opened with the contents on view.
Figure 10:
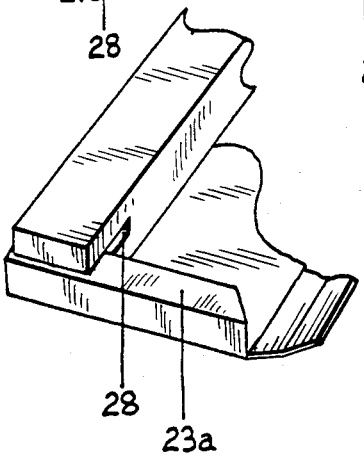
FIG. 10 shows a detail of construction of the case of FIG. 8 in cross-section.
Figure 11:
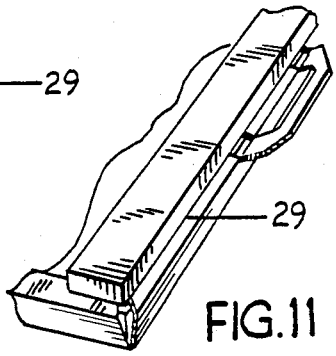
FIG. 11 shows a further constructional detail of FIG. 8.

FIG. 9 shows case 23 in its partly open form. It will be apparent from FIG. 9 that the blank constituting the case has been folded twice, at the margins, so as to leave innermost margin portions 23 parallel to the flat wall of the case. Within the case 23 are held four sections 24*a*–24*d* of post 24, a rectangular packing box 25 and angled irons 26 and 27. Each post section is grooved at 28, at each end, and one of the sections (24*a*) is grooved along it length at 29 (see also FIG. 12). The post sections are arranged side by side within the case so that the innermost margins 23*a* formed by folding in the edge regions of the blank are held within the aligned end grooves 28 of the post sections, and so that the same margin 23*a* at the top of the case is held throughout its length within the longitudinal groove 29 of one of the sections 24*a*, as shown. FIGS. 10 and 11 show details of these constructions, with only one margin 23*a* shown for clarity of illustration.

Figure 12:
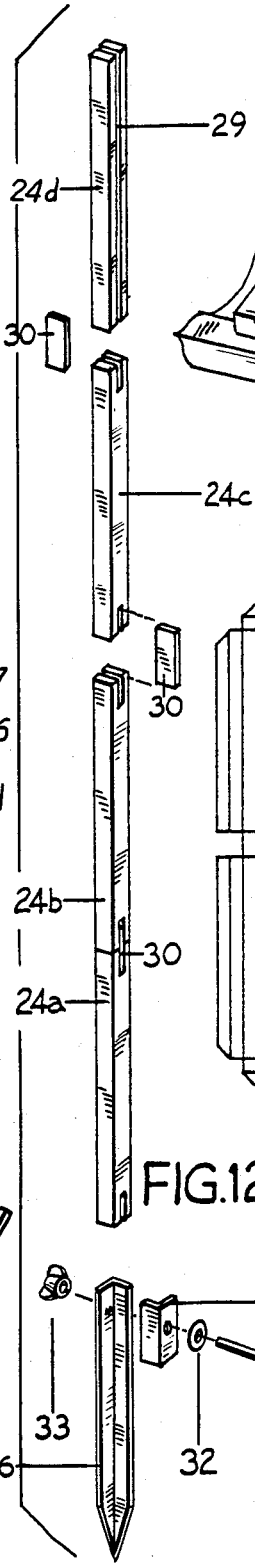
FIG. 12 shows the assembly of a post in accordance with the embodiment of FIG. 8.

FIG. 12 shows the post sections arranged vertically. These sections can be mutually secured to one another by a tennon 30, tapped in from the sides of the posts so as to make a single erect structure and to leave in each case a small space at the top or bottom e.g. for a securing wire to pass through. At the base of the post it is preferred to have an iron member actually to enter the ground. This can be achieved by suitable assembly of the angled irons 26 and 27 as shown located in the case using bolt 31, washer 32 and nut 33.

Packing 25 as shown contains the necesary literature, bolts, wire, the tennon tabs, glue etc. as described above in respect of the embodiment of FIG. 1.

Figure 8:
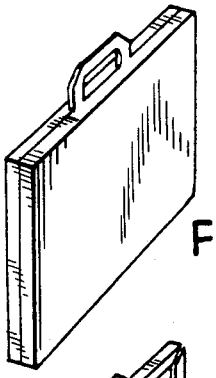
FIG. 8 shows an alternative form of case in its transit or delivery mode.
Figure 13:
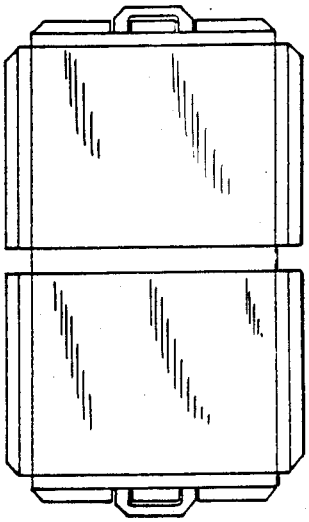
FIG. 13 shows the blank case of FIG. 8, and FIGS. 14–17 show respectively internal stabilising packaging in perspective from each of two directions; a detail of the packaging configuration in cross-section; and an assembled and supported sign; all according to another variant of the invention.

FIG. 13 shows the blank itself of FIG. 8, which on one side can be provided with advertising material, on the other side provided with a suitable surface to constitute the exterior of a carrying case. It will be apparent that when the blank is turned inside out to constitute an advertising aid, the particular configuration of margins 23*a* also lends itself to allowing such a margin to project *outwards* from the hollow interior (rather than inwards). In such an instance, these outward projecting marginal areas along one side enter the longitudinal groove 29 in the uppermost section 24*a* of FIG. 12. The remaining margin portions 23*a* within the sign, face one another and can be mutually attached by adhesive or secured to an adhesive strip extending all the way round the sides.

It will be apparent that if desired the outside of the carrying case itself can be constituted as the advertising side, so that when it is opened to remove the contents all that is necessary, instead of radical refolding, is rearranged such as to fold out one of the marginal side portions 23*a* and to accommodate it in the other longitudinal grooves 29 at the top of the assembled post.

Various modifications may be made in the invention. For example FIG. 14 shows a block or tray 34 of expanded polystyrene shaped on one face with recesses 35 for holding the various component parts of the kit and fitting essentially the whole carrying case cavity. The edges of the case, and of the assembled sign, as in FIG. 8, fit into a groove 36, formed in this instance around three sides of the polystyrene block 34, as shown in FIGS. 14, 15 and 16.

Also shown in FIGS. 14, 15 and 16 is a cylindrical hole 37 opening into the grooved long side of the block at 38 and in the ungrooved long side of the block at 39. By means of this a tubular post of interfilling metal sections 40 can be assembled to the block 34, which stays within and helps stabilise the erected sign shown in FIG. 17.

What is claimed is:

1. A portable kit of parts for assembly into a display sign, comprising:

(a) a blank having first and second opposed surfaces, said blank being foldable in a first direction along a plurality of predetermined fold lines such that an enclosed geometric shape is formed having an external face comprising a portion of said first surface and alternatively being foldable in a second direction along at least a portion of said plurality of predetermined fold lines such that said enclosed geometric shape is formed with an external face comprising at least a portion of said second surface;

(b) a releasable closure for securing said folded blank in said enclosed geometric shape;

(c) indicia printed on said first surface;

(d) a handle connected to and arranged outside of said enclosed geometric shape when said second surface forms said external face;and (e) a plurality of support members having coupling means whereby said support members can be connected in series to form an assembled pole, the topmost support member of said pole having means for fastening said folded blank thereon when said first surface forms said external face of said enclosed geometric shape, each of said support members being dimensioned to fit neatly inside said folded blank when said second surface forms said external face and said pole is disassembled, wherein said folded blank functions as a carrying case when said second surface forms said external face and said handle extends outside of said folded blank, and said folded blank functions as a display sign when said first surface forms said external face and said display sign is connected to said topmost support member of said assembled pole with said advertising indicia visible.

2. A kit of parts as claimed in claim 1 in which the closure is a strip of polymer double-leafed along each edge to fit over an edge of the foldable blank material, and flexible to follow the case periphery and the periphery of said formed sign.

3. A kit of parts as claimed in claim 1 in which the closure is constructed by folding the margins of the blank firstly to give a wall portion, and secondly an innermost marginal portion parallel to the face of the blank and suitable for one of single and joint entrapment by localized contents of the case when un-opened and for like entrapment by the support when the sign is supported thereby.

4. A kit of parts as claimed in claim 1 in which the advertising indicia are applied twice to the blank so that the sign is double-sided when supported.

5. A kit of parts as claimed in claim 1 in which the case is made of weather resistant sheet material comprising a cellulosic core and polymeric facing.

6. A kit of parts as claimed in claim 1 in which one of the support members is pointed at one end, for hammering into the ground and includes said interconnection means at the other end for joining to said support post.

7. A kit of parts as claimed in claim 1 in which a pointed metal member is provided for holding a support length and to facilitate hammering into the ground.

8. A kit of parts as claimed in claim 1 dimensioned and apertured to permit the topmost support member of said assembled support post to be thrust between the side faces of the sign and be connected thereto.

9. A kit of parts as claimed in claim 3 in which at least the topmost support member of the assembled support post is longitudinally grooved, and in which all such support members are grooved across their ends, when the case is closed and the support members lie side by side therein the support members jointly define grooves at their ends, as well as the groove along one length, all for holding the innermost margins, when the case is opened and refolded as a sign one pair of innermost margins is presented by be held by the longitudinal groove in the top support member.

10. A kit of parts as claimed in claim 1 further comprising at least one of a group of contents including a securing device, adhesive, length of wire, nuts and bolts, adhesive tape, gloves, booklets, leaflets, labels and detachable-letter sheets.

11. A kit of parts as in claim 1 further comprising an internal stabilizing packaging block or tray of essentially the same dimensions as the interior of the assembled case or sign, and configured to localize the other components of said kit within the case prior to assembly as a sign.

12. A kit as claimed in claim 1, wherein said case is formed at least in part of cellulosic material, making said sign light in weight.

13. A kit as claimed in claim 1 wherein said support members when within said case by their transverse crossection maintain a desired separation between said opposed sides by pressing against said sides.

* * * * *